US009173535B2

(12) United States Patent
Suijver et al.

(10) Patent No.: US 9,173,535 B2
(45) **Date of Patent: *Nov. 3, 2015**

(54) CLEANING DEVICE WITH AERODYNAMIC OSCILLATOR

(71) Applicant: KONINKLIJKE PHILIPS N.V., Eindhoven (NL)

(72) Inventors: Jan Frederik Suijver, Dommelen (NL); Daniel Uhlmann, Besigheim (DE); Gerben Kooijman, Heeze (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 14/371,207

(22) PCT Filed: Jan. 30, 2013

(86) PCT No.: PCT/IB2013/050793

§ 371 (c)(1),
(2) Date: Jul. 9, 2014

(87) PCT Pub. No.: WO2013/114299

PCT Pub. Date: Aug. 8, 2013

(65) Prior Publication Data

US 2014/0373308 A1 Dec. 25, 2014

(30) Foreign Application Priority Data

Feb. 2, 2012 (EP) ..... 12153574

(51) Int. Cl.

| | |
|---|---|
| ***A47L 5/00*** | (2006.01) |
| ***A47L 9/04*** | (2006.01) |
| ***A47L 5/14*** | (2006.01) |
| *A47L 9/00* | (2006.01) |

(Continued)

(52) U.S. Cl.

CPC ..... *A47L 9/0483* (2013.01); *A47L 5/14* (2013.01); *A47L 5/20* (2013.01); *A47L 5/30* (2013.01); *A47L 9/0072* (2013.01)

(58) Field of Classification Search

CPC ..... A47L 5/14; A47L 5/20; A47L 5/30; A47L 9/0072; A47L 9/0483; B08B 5/04

USPC ..... 15/345, 346, 363, 379, 404

See application file for complete search history.

(56) References Cited

U.S. PATENT DOCUMENTS 5,400,466 A 3/1995 Alderman et al.
8,857,013 B2 * 10/2014 Kooijman et al. ..... 15/363

FOREIGN PATENT DOCUMENTS

DE 880474 C1 6/1953
DE 880474 T1 6/1999

(Continued)

OTHER PUBLICATIONS

Ryan Holman et al, "Formation Criterion for Synthetic Jets", AIAA Journal, vol. 43, No. 10, Oct. 2005, pp. 2110-2116.

(Continued)

*Primary Examiner* — David Redding

(57) ABSTRACT

A cleaning device (1) for cleaning a carpet (70) having face yarns (74) that extend over a distance of several millimeters from a generally planar backing (72) to define a carpet surface (76), comprising: an oscillator unit (30), including: an oscillator (32); an oscillation space (34) defined by or accommodating at least part of the oscillator, and accessible through a jet opening (36) via which ambient fluid is alternatingly drawn into the oscillation space and expelled from the oscillation space during operation of the oscillator; a nozzle (10), including a carpet surface penetrator (14) that defines said jet opening; a support structure (12) configured to support the nozzle against the carpet, such that, in a supported condition of the nozzle against the carpet, the penetrator penetrates the carpet surface and the jet opening is disposed at least partially below the carpet surface.

12 Claims, 3 Drawing Sheets

(51) Int. Cl.
*A47L 5/30* (2006.01)
*A47L 5/20* (2006.01)

(56) References Cited

FOREIGN PATENT DOCUMENTS

| | | | |
|---|---|---|---|
| GB | 901179 | A | 7/1962 |
| GB | 2393384 | A | 3/2004 |
| GB | 2393384 | B | 7/2005 |
| JP | 9140641 | A | 6/1997 |

OTHER PUBLICATIONS

J.M. Shuster et al, "A Study of the Formation and Scaling of a Synthetic Jet", 42nd AIAA Paper, Jan. 5-8, 2004, 2004-00090.

* cited by examiner

CLEANING DEVICE WITH AERODYNAMIC OSCILLATOR

CROSS-REFERENCE TO PRIOR APPLICATIONS

This application is the U.S. National Phase application under 35 U.S.C. §371 of International Application No. PCT/IB2013/050793, filed on Jan. 30, 2013, which claims the benefit of European Patent Application No. 12153574.4, filed Feb. 2, 2012. These applications are hereby incorporated by reference herein.

FIELD OF THE INVENTION

The present invention relates to a cleaning device, comprising an oscillator unit configured to aerodynamically agitate a surface, e.g. a floor covering such as a carpet, and to thereby first dislodge and subsequently remove dirt particles, e.g. dust, trapped therein.

BACKGROUND OF THE INVENTION

In the art various vacuum cleaning devices have been disclosed whose operating principle is based on vibrating airwaves or airstreams to promote the release of dirt from a carpet. The use of vibrating airwaves may provide for better dirt release capability than conventional vacuum cleaners, which merely use steady air stream suction to both release and remove dirt from the carpet, and avoid the wear of the carpet that is typically caused by vacuum cleaners that employ mechanical agitation systems, such a beating or rotating brushes.

An example of a vibrating air wave based vacuum cleaner is disclosed by U.S. Pat. No. 5,400,466 (Alderman et al.). The vacuum cleaner features an air vibration suction nozzle for application to a carpet, wherein air vibration produced by a transducer, such as a loudspeaker, supported and sealed in the nozzle housing, vibrates the carpet and the dirt captured therein so as to loosen dirt particles from the carpet in order to enable them to be drawn into the vacuum cleaner through the suction nozzle.

It is known from DE880474C to provide a cleaning device for cleaning a carpet having face yarns that extend over a distance of several millimeters from a generally planar backing to define a carpet surface, comprising: an oscillator unit, including an oscillator; an oscillation space that is at least partially defined by or accommodates at least part of the oscillator, and that is accessible through a jet opening via which ambient fluid is alternatingly drawn into the oscillation space and expelled from the oscillation space during operation of the oscillator; and a nozzle, including a support structure configured to support the nozzle against the carpet.

SUMMARY OF THE INVENTION

The disadvantages of known vibrating airwave or airstream based vacuum cleaners include that they often suffer from suboptimal cleaning performance, and fully rely on the presence of an additional suction system to provide for an air stream that transports dirt released from a carpet to a dirt collection container of some sort.

It is an object of the present invention to overcome or obviate one or more of the abovementioned disadvantages associated with known vibrating air based vacuum cleaners.

A cleaning device for cleaning a carpet having face yarns that extend over a distance of several millimeters from a generally planar backing to define a carpet surface according to the present invention is characterised by a carpet surface penetrator that defines said jet opening and protrudes from the support structure such that, in a supported condition of the nozzle in which the support structure is supported against a carpet, the carpet surface penetrator penetrates the carpet surface and the jet opening is disposed at least partially below the support structure and the carpet surface.

The oscillator unit may be configured to alternatingly, e.g. at a frequency of several hundreds of Hertz, effect an inflow and outflow of ambient fluid respectively into and out from its oscillation space. Subjecting a carpet to the rapidly changing ambient fluid flow may agitate and dislodge dirt captured therein, and cause the dirt to be entrained in the fluid flow. The oscillator unit may serve to both suck up dirt entrained in the ambient fluid from a carpet upon inflow, and to eject the dirt upon outflow. Furthermore, the design of the unit may be such as to ensure that the inflow and outflow directions of ambient fluid are non-identical. Accordingly, the inflow of ambient air may involve a fluid flow from/through the carpet, while the outflow may involve a fluid flow away from the carpet, e.g. towards a dirt collection provision or into a secondary dirt transport fluid flow towards such a provision.

A key aspect of the present invention is the carpet surface penetrator that defines the jet opening of the oscillator unit, and that enables the jet opening to be positioned at least partially below a carpet's surface, i.e. inside/within the face yarns or pile of the carpet. As will be elucidated and discussed in more detail below, the position of the jet opening relative to the carpet surface level is of prime importance to the effectiveness of the oscillator in dislodging dirt from the face yarns of the carpet. The penetrator, in a supported condition of the nozzle against the carpet, penetrates the carpet surface to such an extent that the jet opening is disposed substantially below the carpet surface. More particularly, given a typical face yarn length of about nine millimeters, the jet opening may preferably be disposed in between 0.5 and 2 mm below the carpet surface during operation, wherein this distance (as far as the position of the jet opening is concerned) may be measured from a circumferential edge portion of the jet opening proximal to the carpet backing.

To ensure that the carpet surface penetrator penetrates the carpet to an optimal extent (as just described), the nozzle of the cleaning device is fitted with a support structure. The support structure is configured to support the nozzle against the carpet, either against the backing or against the carpet surface thereof.

For supporting the nozzle against the backing of a carpet, the support structure of the nozzle may include one or more wheels or spacers.

For supporting the nozzle against the carpet surface of a carpet, the support structure of the nozzle may include a generally planar, preferably smooth, external support surface. At least a part of the penetrator may protrude outwardly from this external support surface, such that the jet opening defined by the penetrator is at least partially disposed outward of the support surface, and preferably such that the entire jet opening is substantially disposed outward of the support surface, in particular at a distance in the range of 0.5-2 mm there from (as far as the position of the jet opening is concerned, this distance may be measured from a circumferential edge portion of the jet opening distal to the external support surface). During use, the external support surface may bear upon the carpet surface, which may thus conveniently define an elevation reference for the penetrator. A smooth surface profile of the support surface may further warrant easy, unhindered movement of the nozzle across a carpet. It will be clear that, to ensure such unhindered movement, the protruding penetrator may preferably also have a smooth profile so as to avoid it catching on face yarns of the carpet.

In one embodiment of the cleaning device, the oscillation space may define a typically conduit- or tube-shaped jet channel at an end of which the jet opening is provided. At the jet opening the jet channel may extend outwardly in a jet direction.

In a supported condition of the nozzle against the carpet, the jet direction may preferably face away from the carpet's backing to ensure that dirt-containing ambient fluid that is sucked up from the carpet will not be expelled/ejected back into the carpet again. In a supported condition of the nozzle against the carpet, the jet direction may preferably face away from the carpet's backing, and include an angle in the range of 15-45 degrees therewith. Angles within this range have been found to both enable suitable inflow of ambient fluid from the carpet, and outflow of ambient fluid in a direction away from the carpet.

To enhance the asymmetry between the inflow of ambient fluid into tube-shaped jet channel of the oscillation space and the outflow of ambient fluid there from, and more particularly to prevent the omni-directional inflow of ambient fluid, the structural wall defining the jet channel may be provided with an overshot. That is, at the jet opening, the jet channel may be defined by a jet channel wall having a first section and a second section. In a supported condition of the nozzle against the carpet, the first section may be proximal to the carpet's backing while the second section may be distal to the carpet's backing, and the second section may extend beyond the first section in the jet direction. The overshot of the second section relative to the first may increase the inflow of ambient fluid into the jet channel from the side of the carpet, while it may reduce the inflow of ambient fluid into the jet channel from the side opposite to the carpet. Accordingly, the suction power provided by the oscillator may be advantageously focused on the carpet. In practical embodiments, the second section may preferably extend 0.5-5 mm beyond the first section. Smaller overshots appear to produce little effect, while larger overshots tend to inhibit the discharge of ambient fluid from in front of the jet opening and just take up space within the nozzle, thus needlessly increasing its size.

In one embodiment, the cleaning device may further comprise a fluid suction unit, including a dirt discharge duct having a suction end that, in a supported condition of the nozzle against the carpet, faces the carpet, and a fluid flow generator that is operably connected to the dirt discharge duct and that is configured to generate a fluid flow through the dirt discharge duct by effecting underpressure (relative to the ambient) at the suction end. The jet opening of the oscillator unit may face the suction end of the dirt discharge duct, such that, during operation, fluid expelled from the oscillation space through the jet opening is effectively injected into the generated fluid flow at the suction end and entrained therein.

These and other features and advantages of the invention will be more fully understood from the following detailed description of certain embodiments of the invention, taken together with the accompanying drawings, which are meant to illustrate and not to limit the invention.

DETAILED DESCRIPTION

Figure 1:
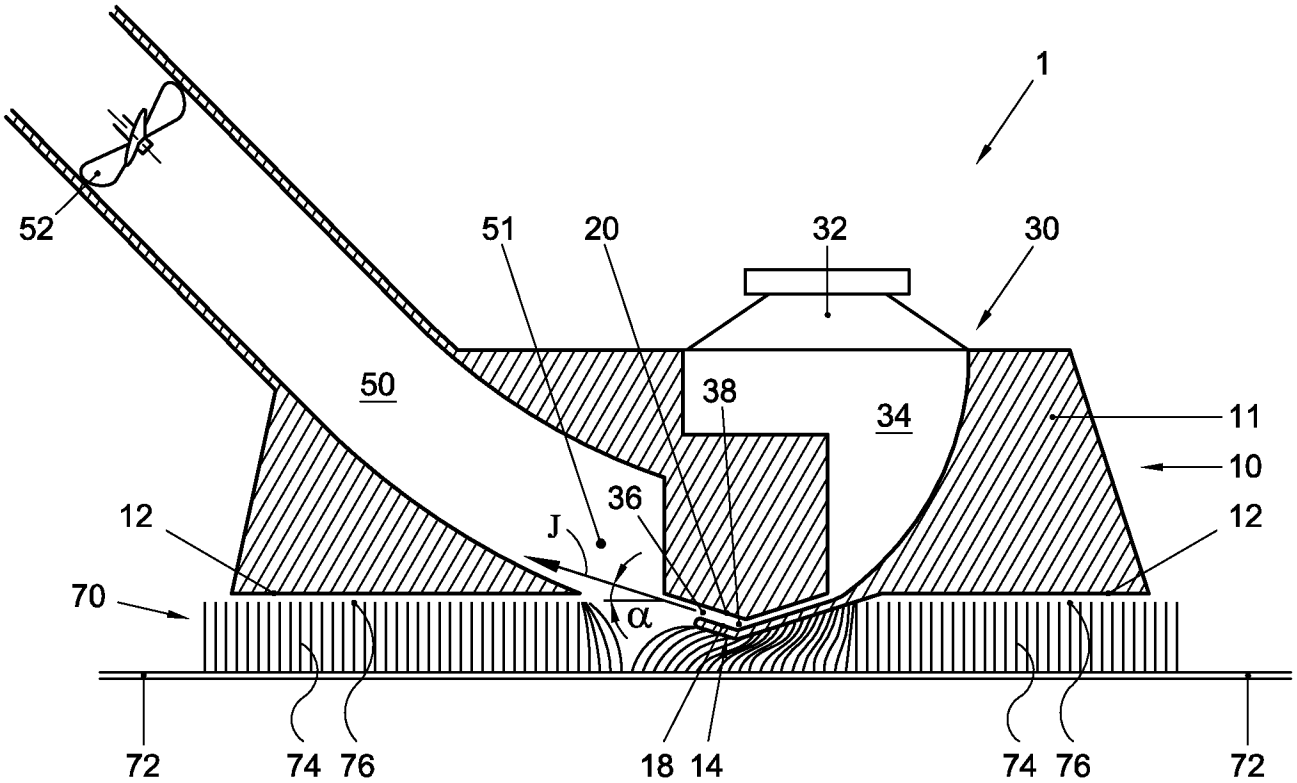
FIG. 1 is a schematic cross-sectional side view of an exemplary embodiment of a cleaning device according to the present invention, including an oscillator unit with an oscillator that, in operation, alternatingly causes ambient fluid to be drawn into, and expelled from, an oscillation space of the oscillator unit.

FIG. 1 is a schematic cross-sectional side view of an exemplary embodiment of a cleaning device 1 according to the present invention, disposed on top of a carpet 70. In the exemplary embodiment, the device 1 comprises a nozzle 10, which in turn features an integrated oscillator unit 30. It is understood that the nozzle 10 and the oscillator unit 30, mutually integrated or not, may be implemented in and/or used with (vacuum) cleaning devices otherwise known per se. The nozzle 10, for instance, may generally be used at the position of the nozzle or cleaning head of such a (vacuum) cleaning device, while the oscillator unit 30 may be entirely positioned within the nozzle 10, or be partly positioned away from/outside of the nozzle 10, but always such that the nozzle 10 features a jet opening 36 via which an immediate ambient of the nozzle 10 is in fluid communication with an oscillation space 34 of the oscillator unit 30. In one embodiment, for example, the cleaning device 1 may comprise a conventional vacuum cleaner, including a typically wheeled base body (accommodating an air pump, a dust bag, etc.) and a nozzle that is connected thereto via a flexible vacuum hose, wherein the oscillator 32 is positioned in the base body while the jet opening 36 is positioned in the nozzle, and wherein the oscillator 32 is in fluid communication with the jet opening via an oscillation space 34 that is defined by a tube that extends from the oscillation space 34 to the nozzle 10, for example within or in parallel with the vacuum hose.

The cleaning device 1 according to the present invention is particularly configured for cleaning a carpet or carpet-like floor covering 70 having face yarns or (face) pile 74 that extend(s) over a distance of several millimeters, typically about 5-13 mm, e.g. 9 mm, from a generally planar backing 72 to define a carpet surface 76. Each of FIGS. 1-4 therefore depicts the cleaning device 1 in an operational position on top of such a carpet 70.

As is shown in FIG. 1, the nozzle 10 of the cleaning device 1 may include a housing 11. The nozzle housing 11 may in principle be made from any suitable material, but a light weight and structurally strong housing 11 may preferably be manufactured by means of injection moulding a plastic.

The cleaning device 1 includes an oscillator unit 30, which in the depicted embodiments is integrated with the nozzle housing 11. The oscillator unit 30 includes an oscillator 32, and an oscillation space 34 that is at least partially defined by, or that accommodates at least part of, the oscillator 32 and that is accessible via a jet opening 36.

The oscillator 32 may typically include an electroacoustic transducer, e.g. a (loud) speaker, configured to produce pressure oscillations in a fluid present in the oscillation space 34 in response to an electrical input signal from a signal source (not shown). The oscillator 32 may be set up to produce oscillations having frequencies on the order of several hundreds of Hertz, e.g. in the range of 100-300 Hz. Each oscillation may define a suction phase and an expulsion phase during which ambient fluid is respectively drawn into the oscillation space 34 and expelled from the oscillation space 34 via the jet opening 36. The oscillator unit 30 may be dimensioned such that fluid velocities at the jet opening 36 are in the range of approximately 30-60 m/s when the oscillator frequency is in the range of 100-300 Hz.

The oscillation space 34 may be formed by a cavity within the nozzle housing 11, and be at least partially defined by the oscillator 32. For instance, in case the oscillator 32 is a dynamic loudspeaker, the movable diaphragm or cone of the loudspeaker may define a part of the wall bounding the cavity. Alternatively, the oscillation space 34 may be generally defined by a static (i.e. immovable), internal wall of the nozzle 10, and the oscillator 32 may simply be disposed inside the oscillation space 34. The oscillation space 34 may define a tube-shaped jet channel 38 at an end of which the jet opening 36 may be provided. In principle, the jet channel 38 may have any suitable cross-sectional, and the jet opening 36 may have any suitable shape.

Figure 2:
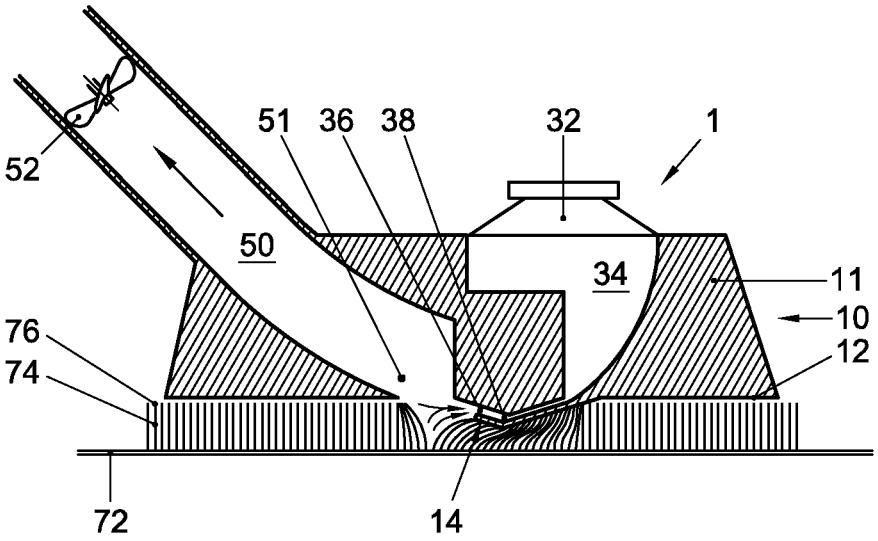
FIG. 2 is a schematic cross-sectional side view of the cleaning device of FIG. 1, shown in an operational state in which the oscillator causes ambient fluid to be drawn into the oscillation space.
Figure 3:
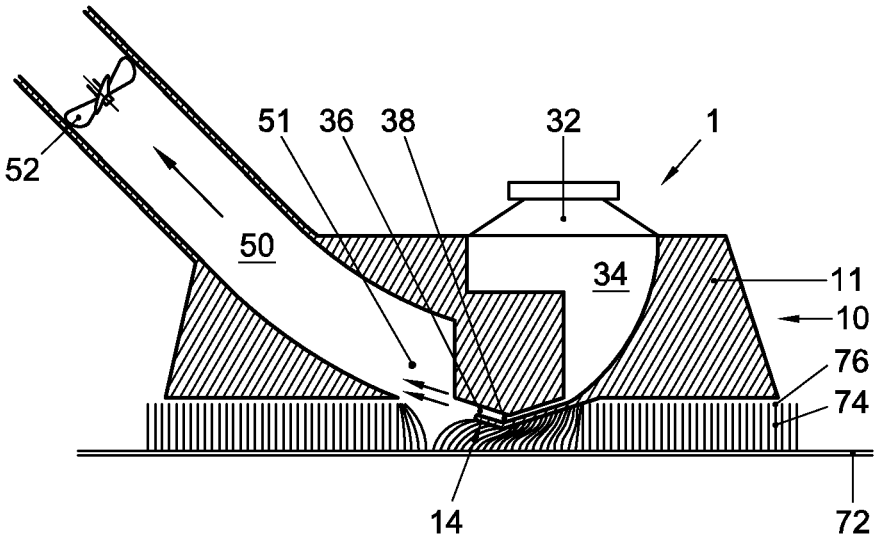
FIG. 3 is a schematic cross-sectional side view of the cleaning device of FIG. 1, shown in an operational state in which the oscillator causes ambient fluid to be expelled from the oscillation space.

The oscillator unit 30 as a whole may preferably be configured such that, during its operation, an asymmetry exists between the suction phase and the expulsion phase of an oscillation. During the suction phase, ambient fluid may be drawn into the oscillation space 34 via the jet opening 36 from various directions, while during the expulsion phase, the same previously drawn in ambient fluid may be expelled in a directed, so called 'synthetic', jet. This asymmetry is schematically depicted in FIGS. 2 and 3, of which the former illustrates a suction phase and the latter illustrates an expulsion phase. Mathematically, the desired asymmetry may be described in terms of the Strouhal number associated with the design and operation of the oscillator unit 30. In this context, the Strouhal number, St, may be defined as:

$$St = \frac{f * d}{v}, \tag{1}$$

wherein $f$ is the frequency [Hz] of the oscillator 32, d is a characteristic dimension [m] of the jet opening 36, and v is an average fluid velocity [m/s] at the jet opening 36 during an expulsion phase of an oscillation. As a rule of thumb, a Strouhal number •1 may be considered to warrant a minimum of asymmetric operation and jet formation upon expulsion of fluid from the oscillation space 34 via the jet opening 36. However, the maximum value that the Strouhal number is not to exceed may be related specifically to the characteristics of the jet opening 36. For example, if the jet opening 36 is an axi-symmetric opening, e.g. a circular opening, its diameter may be taken as its characteristic dimension d, and the Strouhal number may preferably be •0.5. Alternatively, if the jet opening 36 has an elongate rectangular shape, having a short side of length a and a long side of length b, with b>>a, then the length a of short side may be taken as the characteristic dimension of the jet opening 36, and the Strouhal number may preferably be •0.25, and more preferably •0.10.—More detailed information on synthetic jet formation and criteria therefore can be found in R. Holman, Y. Utturkar, R. Mittal, B. L. Smith, and L. Cattafesta, *Formation Criterion for Synthetic Jets*, AIAA Journal, vol. 43 (10), pp. 2110-2116, 2005 and J. M. Shuster and D. R. Smith, *A Study of the Formation and Scaling of a Synthetic Jet*, AIAA Paper 2004-00090, 2004, which are hereby incorporated by reference.

At least at the jet opening 36, the jet channel 38 of the oscillation space 34 may extend outwardly in a jet direction J. During operation, when the nozzle 10 is supported against a carpet 70, the jet direction J may preferably face away from the carpet's backing 72 to ensure that dirt-containing ambient fluid that was sucked up from the carpet 70 during a suction phase will not be expelled back again into the carpet 70 during a subsequent expulsion phase. In a preferred embodiment, the jet direction J may preferably face away from the carpet's backing 72, and include an angle•(alfa) in the range of 15-45 degrees therewith. Angles within this range have been found to both enable suitable inflow of ambient fluid from the carpet 70, and outflow of ambient fluid in a direction away from the carpet 70.

Furthermore, to enhance the asymmetry between the inflow of ambient fluid into tube-shaped jet channel 38 of the oscillation space 34 and the outflow of ambient fluid therefrom, and more particularly to prevent the omni-directional inflow of ambient fluid, the structural wall 18, 20 defining the jet channel 38 may be provided with an overshot. That is, at the jet opening 36, the jet channel 38 may be defined by a jet channel wall having a first section 18 and a second section 20. In a supported condition of the nozzle 10 against the carpet 70, the first section 18 may be proximal to the carpet's backing 72 while the second section 20 may be distal to the carpet's backing 72, and the second section 20 may extend beyond the first section 18/the jet opening 36 in the jet direction J. The overshot of the second section 20 relative to the first may increase the inflow of ambient fluid into the jet channel 38 from the side of the carpet 70, while it may reduce the inflow of ambient fluid into the jet channel 38 from a side opposite to the carpet 70. Accordingly, the suction power provided by the oscillator 32 is advantageously focused on the carpet 70. In practical embodiments, the second section 20 may preferably extend 0.5-5 mm beyond the first section 18/the jet opening 36. Smaller overshots appear to produce little effect, while larger overshots tend to inhibit the discharge of ambient fluid from in front of the jet opening 36 and just take up space within the nozzle 10, thus needlessly increasing its size.

Figure 4:
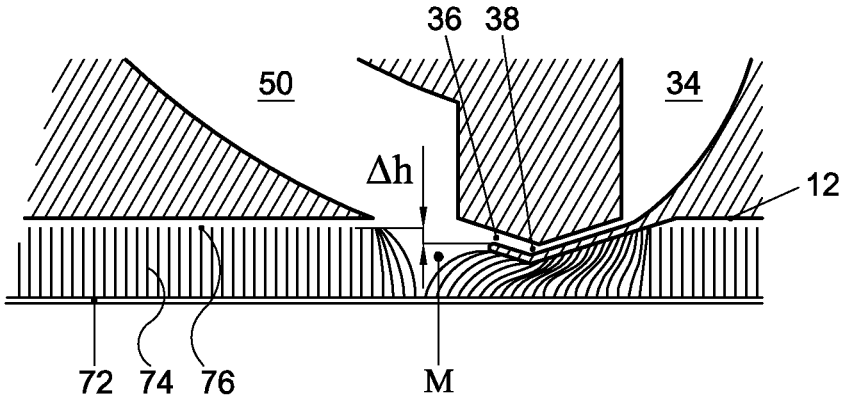
FIG. 4 is a schematic diagram illustrating the relation between a vertical distance of a jet opening of the oscillation space and the carpet surface (depicted on the horizontal axis of the graph) and a vertical fluid velocity ($v_M$) at a point M within an opened carpet section, several millimeters above the carpet backing.
Figure 4:
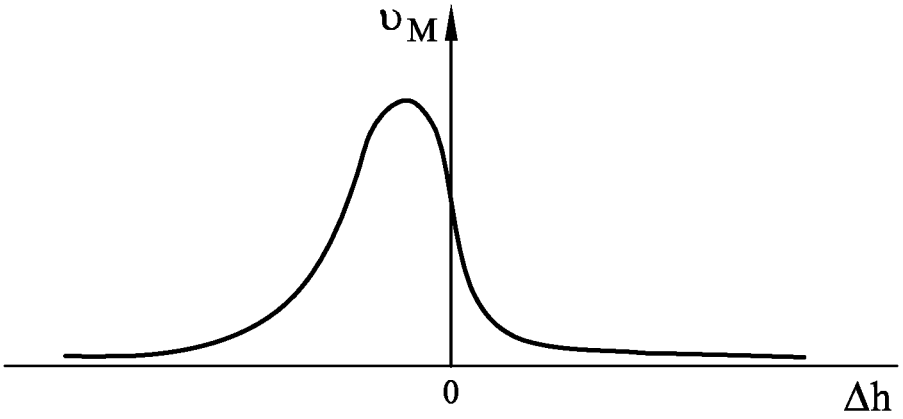

The nozzle 10 further includes a carpet surface penetrator or lip 14 that protrudes from the nozzle housing 11, and that defines the jet opening 36 of the oscillator unit 30. The carpet surface penetrator 14 may serve to space apart the face yarns 74 of a carpet 70 as the nozzle 10 moves across them, and to position the jet opening 36 at least partially below a carpet's surface 76, i.e. inside/amid the face yarns 74. The position of the jet opening 36 relative to the carpet surface level 76 is of prime importance to the effectiveness of the oscillator unit 30 in dislodging and removing dirt from the face yarns 74 of the carpet 70. This may be illustrated with the help of FIG. 4, which shows a schematic diagram illustrating the relation between a distance •h between the jet opening 36 and the carpet surface 76 (depicted on the horizontal axis of the graph) and a fluid velocity $v_M$ at a point M within a spread-open carpet section, several millimeters above the carpet backing 72, during a suction phase. The distance •h and the fluid velocity $v_M$ are both measured perpendicular to the carpet backing 72, such that •h is positive when the jet opening 36 is located above/outside of the face yarn 74 of the carpet 70, and $v_M$ is positive when the local ambient fluid velocity points away from the carpet 70. As indicated, the position of the jet opening 36 is measured from a circumferential edge portion of the jet opening 36 proximal to the carpet backing 72. The curve in the graph of FIG. 4 shows a clear maximum for $v_M$ at a position just below the carpet surface 76. This can be understood by realizing that, on the one hand, a negative value for •h is effected by inserting the carpet surface penetrator 14 into the face yarn 72. The insertion causes compression and local densification of the face yarns 72, which in turn hinders the flow of ambient fluid through the yarns 72, and thus the supply of ambient fluid to the jet opening 36 during a suction phase. A positive value for •h, one the other hand, means that the jet opening 36 is located above the carpet surface 76, which enables ambient fluid to be drawn in from over the carpet surface 76 instead of through the carpet pile 74. Hence, the optimum location for the jet opening 36 appears to be at least partially, and preferably substantially entirely below carpet surface 76. More particularly, given a typical face yarn length of about nine millimeters, the jet opening 36 may be disposed in between 0.5 and 2 mm below the carpet surface 76 during operation.

To ensure that the carpet surface penetrator 14 penetrates the carpet pile 74 to an optimal extent (as just described), the nozzle 10 of the cleaning device 1 is fitted with a support structure. The support structure is configured to support the nozzle housing 11 against the carpet 70, either against the backing 72 or against the carpet surface 76 thereof.

In case the nozzle 10 is configured to be supported against the carpet's backing 72, the support structure may for example include wheels or other spacers, disposed at a bottom or interface side of the nozzle 10, to enable the nozzle 10 to be rolled or slid across a carpet 70 to be cleaned. One drawback of this approach is that movement across the carpet 70 may not be entirely smooth, for instance because the rotation of the wheels is not fluent, or because the spacers periodically catch on the face yarns 74. Another drawback is that a support structure bearing on the carpet's backing 72 essentially defines the plane of the backing 72 as an elevation reference for the penetrator 14 (instead of the carpet's surface 76). For instance, when the nozzle 10 is set up to position a pin-hole jet opening 36 in the penetrator 14 seven millimeters from the plane on which the support structure will bear during use, the jet opening will be located a suitable two millimeters below the carpet surface 76 in case the carpet's face yarns 74 have a length of nine millimeters. However, it will be positioned a sub-optimal six millimeters below the carpet surface 76 in the case of deep-pile carpet with face yarns 74 having a length of about thirteen millimeters, and a dysfunctional three millimeters above the carpet surface 76 in the case of shallow-pile carpet 70 with face yarns 74 having a length of about four millimeters. A support structure configured to support the nozzle 10 against the carpet's backing 72 may therefore preferably include an adjustment mechanism to enable a user to adjust the distance of the penetrator relative to a respective elevation reference depending on the length of the face yarns 74.

To prevent these issues, the support structure of the nozzle 10 may include a generally planar, preferably smooth, external support surface 12 for supporting the nozzle 10 against the carpet surface 76. At least a part of the penetrator 14 may protrude outwardly from this external support surface 12, such that the jet opening 36 defined by the penetrator 14 is at least partially disposed outward of the support surface 12, and preferably such that substantially the entire jet opening 36 disposed outward of the support surface 12, in particular at a distance in the range of 0.5-2 mm there from.

During operation, oscillator unit 30 will periodically expel a jet of ambient fluid containing dirt particles from the jet opening 36. To prevent the dirt particles entrained in the ambient fluid from falling back onto the carpet 70 again, the jet may be aimed at a dirt collection provision, for example in the form of a dirt collection/settling chamber (not shown) provided in the nozzle housing 11, in which the dirt is allowed to settle. Alternatively, the jet may serve to inject the entrained dirt particles into a secondary fluid stream that is bound for a dirt collection provision. For this purpose, the cleaning device 1 may comprise a fluid suction unit 50, 52 as illustrated in the Figures. The fluid suction unit may include a dirt discharge duct 50 having a suction end 51 that, in a supported condition of the nozzle 10 against the carpet 70, faces the carpet 70, and a fluid flow generator 52 that is operably connected to the dirt discharge duct 50 and that is configured to generate a fluid flow through the dirt discharge duct 50 by effecting under pressure (relative to the ambient) at the suction end 51. The dirt discharge duct 50 may typically lead to a dirt collection provision, such as a dust bag or a cyclone (not shown). In the Figures, the fluid flow generator 52 is schematically shown as a fan, disposed inside the dirt discharge duct 50. It is understood, however, that the fluid flow generator 52 may be of any suitable type, and for example include an (electrically power) vacuum or air pump, as is common in vacuum cleaners. The jet opening 36 of the oscillator unit 30 may face the suction end 51 of the dirt discharge duct 50, such that, during operation, fluid expelled from the oscillation space 34 through the jet opening 36 is effectively injected into the generated fluid flow at the suction end 51 and entrained therein to be discharged to be discharged to the dirt collection provision.

Although in the above the oscillator unit 30 has implicitly been described as having one jet opening 36, it is understood that it may in fact comprise a plurality of jet openings 36, defines by one or more surface penetrators. In general, the plurality of jet openings 36 may be arranged in any suitable configuration. In one embodiment, for example, a plurality of jet openings 36 may be aligned across the width or length of the nozzle housing 11. In another embodiment, two pluralities of jet openings 36 may be provided, symmetrically disposed opposite to each other, for instance on opposite sides of a suction end 51 of a dirt discharge duct 50 of a fluid suction unit.

Although illustrative embodiments of the present invention have been described above, in part with reference to the accompanying drawings, it is to be understood that the invention is not limited to these embodiments. Variations to the disclosed embodiments can be understood and effected by those skilled in the art in practicing the claimed invention, from a study of the drawings, the disclosure, and the appended claims. Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, it is noted that particular features, structures, or characteristics of one or more embodiments may be combined in any suitable manner to form new, not explicitly described embodiments.

LIST OF ELEMENTS

1 cleaning device
10 nozzle
11 nozzle housing
12 external support surface
14 penetrator
16 jet channel wall*
18 first or bottom section of jet channel wall
20 second or top section of jet channel wall
30 oscillator unit
32 oscillator

34 oscillation space
36 jet opening
38 jet channel
50 dirt discharge duct
51 suction end of dirt discharge duct
52 fluid flow generator
70 carpet
72 backing
74 face yarns
76 carpet surface
J jet direction
• angle of jet channel relative to carpet surface
d characteristic dimension of the of the jet opening
ƒ oscillator frequency
•h vertical distance between jet opening and carpet surface
v average fluid velocity at jet opening upon expulsion of fluid from the oscillation space
$v_M$ vertical fluid velocity at a point M within a spread-open carpet section, several millimeters above carpet backing

The invention claimed is:

1. A cleaning device for cleaning a carpet having face yarns that extend over a distance of several millimeters from a generally planar backings to define a carpet surface, comprising:

an oscillator unit, including:

an oscillator;

an oscillation space that is at least partially defined by or accommodates at least part of the oscillator, and that is accessible through a jet opening via which ambient fluid is alternatingly drawn into the oscillation space and expelled from the oscillation space during operation of the oscillator;

a nozzle, including a support structure configured to support the nozzle against the carpet, including a carpet surface penetrator that defines said jet opening and protrudes from the support structure such that, in a supported condition of the nozzle in which the support structure is supported against a carpet, the carpet surface penetrator penetrates the carpet surface and the jet opening is disposed at least partially below the support structure and the carpet surface.

2. The cleaning device according to claim 1, wherein, in the supported condition of the nozzle against the carpet, the penetrator penetrates the carpet surface and the jet opening is disposed substantially below the carpet surface.

3. The cleaning device according to claim 1, wherein, in the supported condition of the nozzle against the carpet, the penetrator penetrates the carpet surface and the jet opening is disposed in between 0.5 and 2 mm below the carpet surface.

4. The cleaning device according to claim 1, wherein the support structure includes a generally planar, external support surface for supporting the nozzle against the carpet surface, and wherein at least part of the penetrator protrudes outwardly from the external support surface, such that the jet opening defined by the penetrator is at least partially disposed outward of the support surface.

5. The cleaning device according to claim 4, wherein at least part of the penetrator protrudes outwardly from the external support surface, such that the jet opening defined by the penetrator is substantially disposed outward of the support surface, in particular at a distance in the range of 0.5-2 mm there from.

6. The cleaning device according to claim 1, wherein the oscillation space defines a jet channel at an end of which the jet opening is provided, and wherein the jet channel, at the jet opening, extends outwardly in a jet direction (J).

7. The cleaning device according to claim 6, wherein the jet direction (J), in the supported condition of the nozzle against the carpet, faces away from the carpet's backing.

8. The cleaning device according to claim 7, wherein the jet direction (J), in the supported condition of the nozzle against the carpet, includes an angle in the range of 15-45 degrees with the carpet's backing.

9. The cleaning device according to claim 6, wherein the jet channel, at the jet opening, is defined by a jet channel wall having a first section and a second section, wherein, in the supported condition of the nozzle against the carpet, the first section is proximal to the carpet's backing while the second section is distal to the carpet's backing, and wherein the second section extends beyond the first section in the jet direction (J).

10. The cleaning device according to claim 9, wherein the second section extends 0.5-5 mm beyond the first section.

11. The cleaning device according to claim 1, configured such that, during operation, the following criterion is achievable:

$$\frac{f \cdot d}{v} \leq 1,$$

wherein ƒ is the frequency of the oscillator, d is a characteristic dimension of the jet opening, and v is an average fluid velocity at the jet opening when fluid is expelled from the oscillation space.

12. The cleaning device according to claim 1, further comprising:

a fluid suction unit, including:

a dirt discharge duct having a suction end that, in the supported condition of the nozzle against the carpet, faces the carpet;

a fluid flow generator, operably connected to the dirt discharge duct, and configured to generate a fluid flow through the dirt discharge duct by effecting under pressure at the suction end;

including the jet opening of the oscillator unit faces the suction end of the dirt discharge duct, such that, during operation, fluid expelled from the oscillation space through the jet opening is effectively injected into the generated fluid flow at the suction end and entrained therein.

* * * * *